US006360822B1

(12) United States Patent
Robertson

(10) Patent No.: US 6,360,822 B1
(45) Date of Patent: Mar. 26, 2002

(54) CASING ANNULUS MONITORING APPARATUS AND METHOD

(75) Inventor: David Neil Robertson, Aberdeen (GB)

(73) Assignee: ABB Vetco Gray, Inc., Houston, TX (US)

( * ) Notice: Subject to any disclaimer, the term of this patent is extended or adjusted under 35 U.S.C. 154(b) by 0 days.

(21) Appl. No.: 09/611,478

(22) Filed: Jul. 7, 2000

(51) Int. Cl.[7] ..... E21B 33/14
(52) U.S. Cl. ..... 166/368; 166/382
(58) Field of Search ..... 166/368, 348, 166/382, 88.4, 95.1, 344

(56) References Cited

U.S. PATENT DOCUMENTS

| | | | | |
|---|---|---|---|---|
| 3,618,661 A | | 11/1971 | Peterman | |
| 3,705,623 A | | 12/1972 | van Eek et al. | |
| 3,722,584 A | | 3/1973 | Nelson | |
| 3,788,396 A | | 1/1974 | Shatto, Jr. | |
| 3,794,125 A | | 2/1974 | Nelson | |
| 4,133,378 A | | 1/1979 | Gano | |
| 4,154,298 A | | 5/1979 | Gano | |
| 4,880,060 A | | 11/1989 | Schwendemann et al. | |
| 5,150,987 A | | 9/1992 | White et al. | |
| 5,159,982 A | | 11/1992 | Hynes | |
| 5,366,017 A | | 11/1994 | Voss, Jr. | |
| 5,372,199 A | | 12/1994 | Cegielski et al. | |
| 5,544,707 A | | 8/1996 | Hopper et al. | |
| 5,655,603 A | | 8/1997 | Schulte et al. | |
| 5,667,023 A | | 9/1997 | Harrell et al. | |
| 5,706,896 A | | 1/1998 | Tubel et al. | |
| 5,791,418 A | * | 8/1998 | Milberger et al. | 166/368 |
| 5,868,203 A | * | 2/1999 | Cunningham | 166/344 |
| 6,039,119 A | | 3/2000 | Hopper et al. | |

FOREIGN PATENT DOCUMENTS

EP 0989283 A2 * 3/2000

* cited by examiner

*Primary Examiner*—Frank S. Tsay
(74) *Attorney, Agent, or Firm*—Bracewell & Patterson, L.L.P.

(57) ABSTRACT

A subsea wellhead and completion system which provides for monitoring pressure in the annulus of the production casing through communication passages that are pressure-isolated from tubing annulus passages and production fluid passages. The communication passages route production casing annulus fluid pressure from the production casing annulus through the production casing hanger to a communication passage provided between the wellhead housing and an isolation sleeve that spans and seals between the production casing hanger and the tree and then through the tree to an outlet on external diameter of the tree and thence to monitoring equipment located typically at the rig. A removable closure member is located in the production casing hanger to isolate the communication passage during drilling operations. This closure member is removed after drilling operations are concluded and after the tree is installed, but before the isolation sleeve and tubing hanger are landed.

20 Claims, 4 Drawing Sheets

CASING ANNULUS MONITORING APPARATUS AND METHOD

BACKGROUND OF THE INVENTION

1. Field of the Invention

This invention relates in general to offshore drilling and production equipment, and in particular to a subsea well system for monitoring the pressure in a non-producing string of casing through the completion system.

2. Description of the Prior Art

A subsea well that is capable of producing oil or gas will have a conductor housing secured to a string of conductor pipe which extends some short depth into the well. A wellhead housing lands in the conductor housing. The wellhead housing is secured to an outer or first string of casing, which extends through the conductor to a deeper depth into the well. Depending on the particular conditions of the geological strata above the target zone (typically, either an oil or gas producing zone or a fluid injection zone), one or more additional casing strings will extend through the outer string of casing to increasing depths in the well until the well is cased to the final depth. Each string of casing is supported at the upper end by a casing hanger. The casing hanger lands in and is supported by the wellhead housing.

In some shallow wells and in some fluid injection wells, only one string of casing is set within the outer casing. Where only one string of casing is set within the outer casing, only one casing hanger, the production casing hanger, is landed in the wellhead housing. In this case, the space between the outer or first string of casing and the second or production string of casing is isolated by a casing hanger packoff that seals between the wellhead housing and the production casing hanger.

The more typical case is where multiple strings of casing are suspended within the wellhead housing to achieve the structural support for the well to the depth of the target zone. Where multiple strings of casing must be set within the outer casing, multiple casing hangers are landed in the wellhead housing, each set above the previous one in the wellhead housing. Between each casing hanger and the wellhead housing, a casing hanger packoff is set to isolate each annular space between strings of casing. The last string of casing extends into the well to the final depth, this being the production casing. The strings of casing between the outer casing and the production casing are intermediate casing strings.

When drilling and running strings of casing in the well, it is critical that the operator maintains pressure control of the well. This is accomplished by establishing a column of fluid with predetermined fluid density inside the well. During drilling operations, this fluid is circulated down into the well through the inside of the drillstring out the bottom of the drillstring and back to the surface. This column of density-controlled fluid balances the downhole pressure in the well. When setting casing, the casing is run into the pressure balanced well. A blowout preventer system is employed during drilling and running strings of casing in the well as a further safety system to ensure that the operator maintains pressure control of the well. The blowout preventer system is located above the wellhead housing by running it on drilling riser to the wellhead housing.

When each string of casing is suspended from the casing hanger in the wellhead housing, a cement slurry is flowed through the inside of the casing, out of the bottom of the casing, and back up the outside of the casing to a predetermined point. An open fluid communication passage in the casing hanger leading from the casing annulus to the casing interior would adversely affect the flow path of the cement slurry. This could also cause well pressure control problems for the operator under certain conditions.

In a subsea well capable of producing oil or gas, the production fluids flow through perforations made in the, production casing at the producing zone. A string of tubing extends to the producing zone within the production casing to provide a pressure-controlled conduit through which the well fluids are produced. At some point above the producing zone, a packer seals the space between the production casing and the tubing to ensure that the well fluids flow through the tubing to the surface. The tubing is supported by a tubing hanger assembly that lands and locks above the production casing hanger, either in the wellhead housing, in a tubing hanger spool or in a horizontal or spool tree (further described below).

Subsea wells capable of producing oil or gas can be completed with various arrangements of the production control valves in an assembly generally known as a tree. Trees with the arrangement of production control valves located vertically above and in line with the production tubing are generally called christmas trees. Trees with the arrangement of production control valves offset from the production tubing are generally called horizontal or spool trees.

For wells completed with a christmas tree, the tubing hanger assembly lands in the wellhead housing above the production casing hanger. Alternatively, the tubing hanger assembly lands in a tubing hanger spool, which tubing hanger spool is landed and locked to the wellhead housing. For wells completed with a horizontal or spool tree, the horizontal tree locks and seals on the wellhead housing. A tubing hanger assembly locks and seals in the horizontal tree. When either a tubing hanger spool or horizontal tree is located on the wellhead housing, the blowout preventer system is landed on the tubing hanger spool or horizontal tree, respectively.

The tubing hanger assembly in each of the above subsea well systems normally has a flow passage for communication with the annulus surrounding the tubing. This passage allows for monitoring pressure above the packer between the interior of the production casing and the interior of the tubing. In some cases the well can also be produced through this annulus flow passage. Virtually all producing wells monitor pressure in the annulus flow passage between the interior of the production casing and the interior of the tubing.

A sealed annulus locates between the production casing and the next larger string of casing. Normally there should be no pressure in the annulus between the production casing and the next larger string of casing, because the annular space between the production casing and the next larger string of casing is ordinarily cemented at its lower end and sealed with a packoff at the production casing hanger end. Pressure build up in the annulus between the production casing and the next larger string of casing could collapse a portion of the production casing, compromising the structural and pressure integrity of the well. Monitoring pressure in the annulus between the production casing and the next larger string of casing of a subsea well is shown in patents, however, it is not done commercially to applicant's knowledge. Improvements are desired.

SUMMARY OF THE INVENTION

In a subsea well with a tree assembly including either a tubing hanger spool or a horizontal tree, the annulus pressure between the production casing and the next larger string of casing is monitored through communication passages external to the tubing hanger. A communication passage extends through the production casing hanger from the exterior of the production casing hanger below the casing hanger packoff to an outlet in the interior of the production casing hanger. A port closure sleeve threads to the interior of the production casing hanger.

The port closure sleeve seals on both sides of the communication passage outlet in the interior of the production casing hanger. With the port closure sleeve located as described, the communication passage between the exterior of the production casing hanger and the bore of the production casing is isolated. The port closure sleeve as designed can be removed after the tree assembly is installed. After the tree assembly is installed, a lower end of a tubing hanger orientation sleeve mates in the interior of the production casing hanger. The tubing hanger orientation sleeve seals on its exterior surface with the interior of the production casing hanger at a point below the communication passage outlet in the interior of the production casing hanger. The tubing hanger orientation sleeve lands in the tree assembly. The tubing hanger orientation sleeve seals on its exterior surface with the interior of the tree assembly. A space between the tubing hanger orientation sleeve and the wellhead housing is created through which casing annulus pressure can communicate with a communication passage in the tree assembly.

The communication passages communicate pressure in the annulus of the production casing to the exterior of the tree assembly. A communication line extends to monitoring equipment at the surface for monitoring the pressure in the annulus of the production as described.

In one embodiment, the tree assembly includes as part of its assembly a horizontal tree. The horizontal tree lands on the wellhead housing. A tubing hanger orientation sleeve lands in the horizontal tree and mates to the interior of the production casing hanger. The tubing hanger orientation sleeve isolates a space between the exterior of the tubing hanger orientation sleeve and the interior of the wellhead housing to link the communication passage in the production casing hanger with the communication passage in the horizontal tree.

In another embodiment, the tree assembly includes as part of its assembly a tubing hanger spool. The tubing hanger spool lands on the wellhead housing, with the tree mounted to the upper end of the tubing hanger spool. The tubing hanger orientation sleeve lands in the tubing hanger spool and mates to the interior of the production casing hanger. In this configuration, the tubing hanger orientation sleeve is not necessarily oriented to the tubing hanger spool, although it may be. The tubing hanger orientation sleeve isolates a space between the exterior of the tubing hanger orientation sleeve and the interior of the wellhead housing to link the communication passage in the production casing hanger with the communication passage in the tubing hanger spool. The communication passage in the tubing hanger spool communicates pressure to the exterior of the tubing hanger spool. A communication line extends to monitoring equipment at the surface for monitoring the pressure.

DETAILED DESCRIPTION OF THE INVENTION

Figure 1:
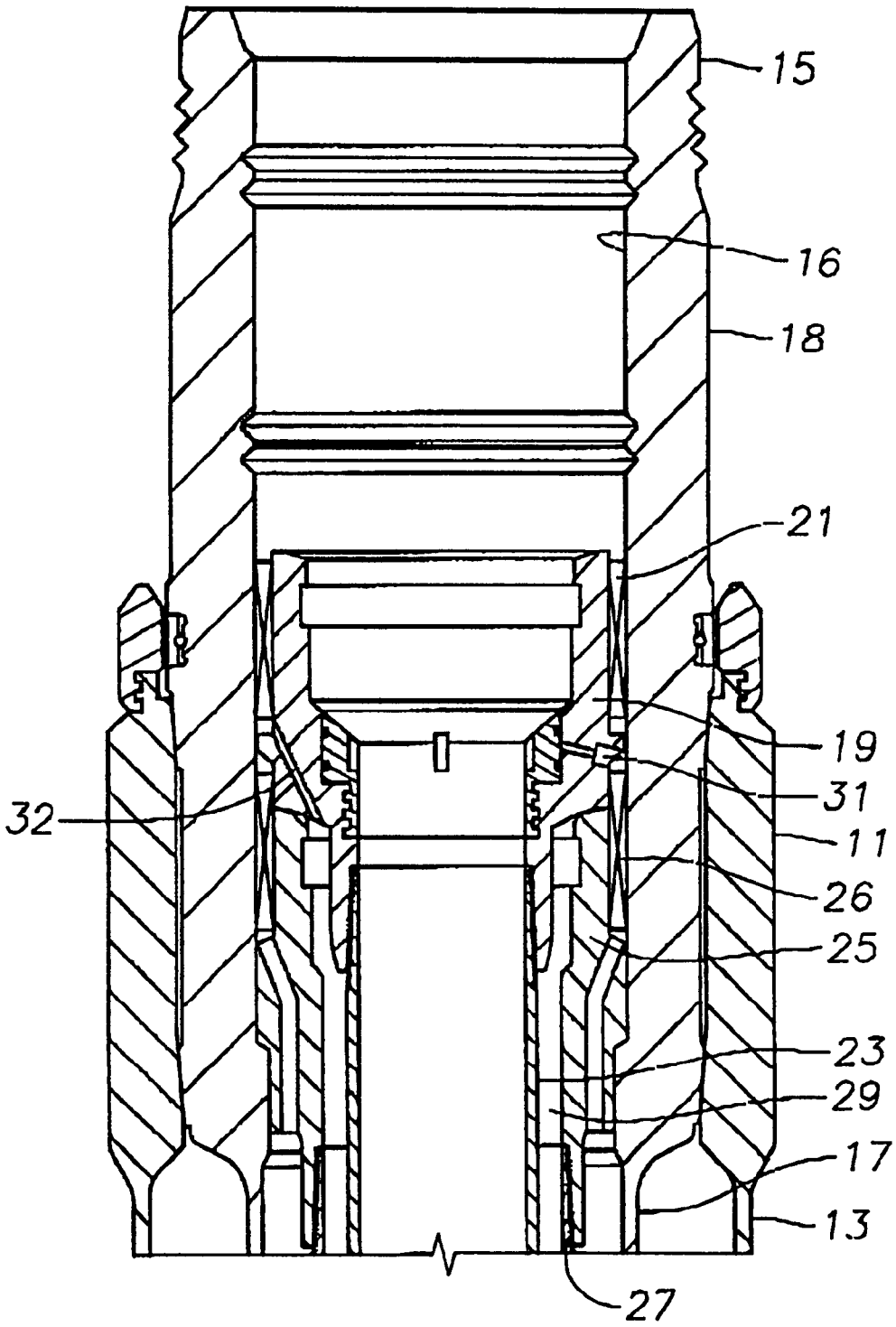
FIG. 1 is a sectional view of a subsea wellhead assembly constructed in accordance with this invention, shown prior to installation of a tree assembly.

Referring to FIG. 1, one configuration for the subsea wellhead assembly includes a conductor housing 11, which will locate at the sea floor. Conductor housing 11 is a large tubular member that is secured to a string of conductor pipe 13. Conductor pipe 13 extends some short depth into the well and is typically 30 or 36 inches in diameter.

A wellhead housing 15 lands in the conductor housing 11. Wellhead housing 15 is a high pressure tubular member having an interior surface 16 and an exterior surface 18. Wellhead housing 15 secures to a first string of casing 17, normally 20 inches in diameter, which extends through the conductor pipe 13 to a deeper depth into the well. Normally, first string of casing 17 is cemented in place.

An intermediate casing hanger 25 and intermediate casing 27 are installed in wellhead housing 15 and casing 17. The intermediate casing hanger 25 lands on a lower shoulder in the interior surface of the wellhead housing 15 below the production casing hanger 19. The intermediate casing hanger 25 is sealed by an intermediate casing hanger packoff 26 to the interior surface 16 of the wellhead housing 15. Intermediate casing hanger 25 secures to a string of intermediate casing 27, typically between 10 and 16 inches in diameter, with larger diameter than the production casing 23, and with smaller diameter than the first string of casing 17. Intermediate casing 27 extends between the first string of casing 17 and the production casing 23 to an intermediate depth. Normally, intermediate casing 27 is cemented in place.

A production casing hanger 19 having an interior surface and an exterior surface lands on a shoulder on the intermediate casing hanger 25. Production casing hanger 19 is sealed by a production casing hanger packoff 21 to the interior surface 16 of the wellhead housing 15. Production casing hanger 19 secures to a string of production casing 23, typically between 7 and 16 inches in diameter. Production casing 23 extends through the intermediate string of casing 17 to a final depth of the well. Normally, production casing 23 is cemented in place.

A production casing annulus 29 exists in the space surrounding the production casing 23. Production casing annulus 29 also surrounds production casing hanger 19 up to production casing hanger packoff 21. Normally, there would be only nominal, atmospheric pressure in the production casing annulus 29. Only a lower portion of production casing 23 is exposed to well pressure and this exposure is through perforations (not shown). A packer (not shown) will locate in production casing 23 above these perforations to seal the well pressure within the lower portion of production casing 23. Pressure other than atmospheric exists in production casing annulus 29 only when a leak occurs.

A communication passage 31 extends laterally through production casing hanger 19 from exterior surface to interior surface. This passage allows fluid communication between the production casing annulus 29 and the interior surface of production casing hanger 19.

Figure 2:
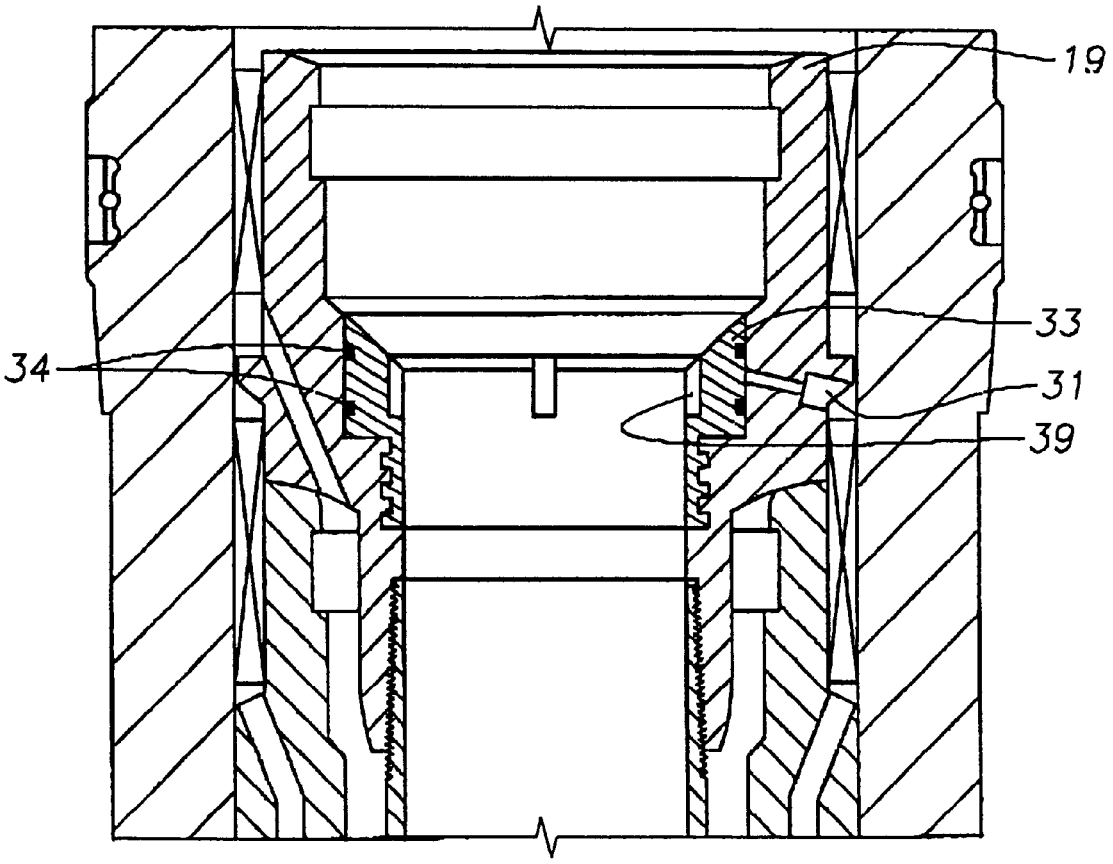
FIG. 2 is an enlarged sectional view of a portion of the subsea wellhead assembly of FIG. 1.

While pumping cement down the casing, cement returns through flowby slots 32 should not enter the bore of casing hanger 19. When production casing 23 is being installed, fluid communication between the interior surface and the exterior surface is not desired. As depicted in FIG. 2, communication passage 31 may be sealed from fluid communication prior to completion by using a port closure sleeve 33 with upper and lower seals 34. Seals 34 locate above and below communication passage 31. Port closure sleeve 33 is threadably connected to production casing hanger 19. Port closure sleeve 33 has an interior surface and an exterior surface. A slot 39 in the interior surface of port closure sleeve 33 allows a tool (not shown) to unscrew the port closure sleeve 33 from the production casing hanger 19 and remove the port closure sleeve 33 through a tree assembly (not shown in FIG. 2) installed on the wellhead housing 15, prior to running tubing.

Figure 3:
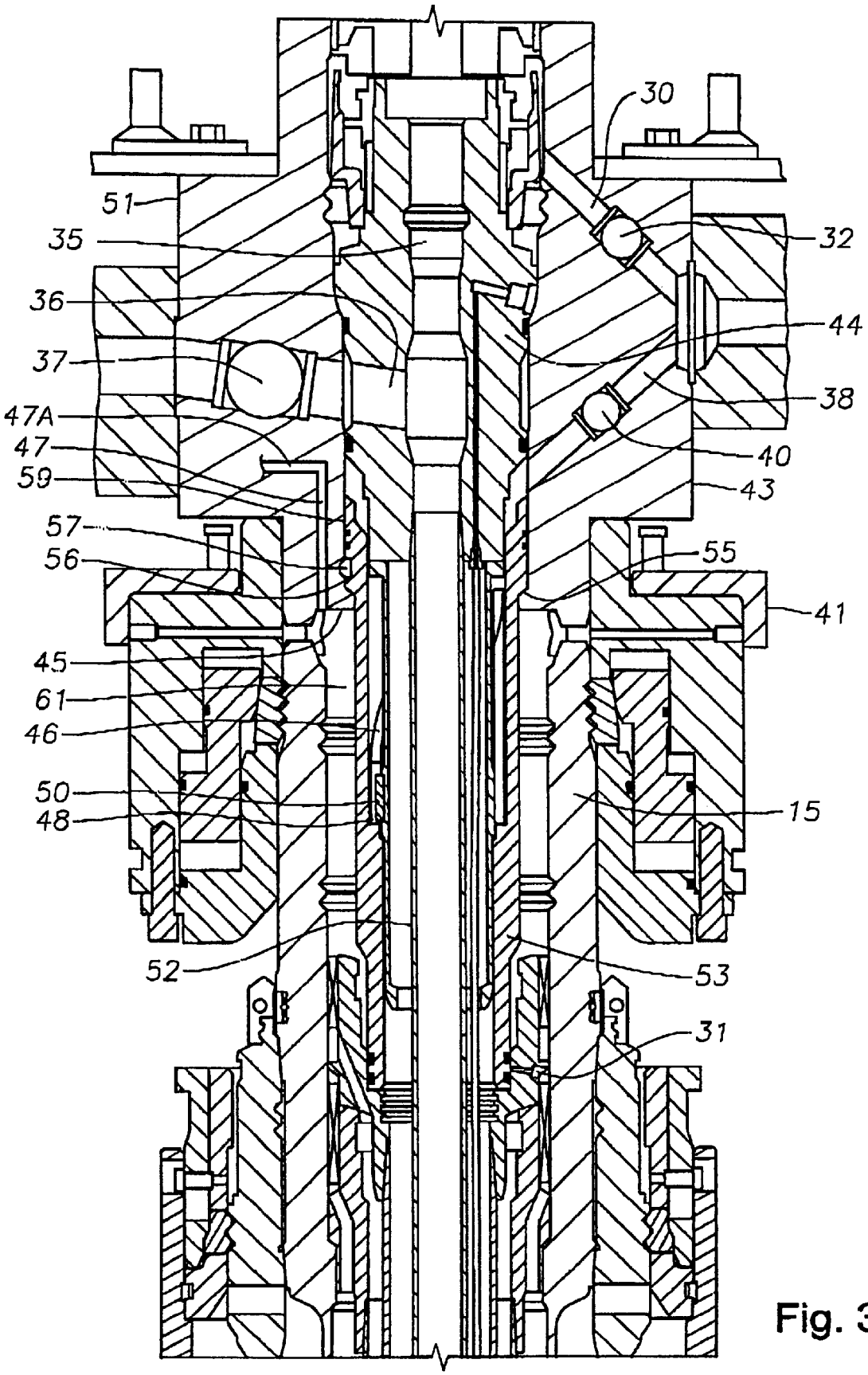
FIG. 3 is a sectional view of a first embodiment of a subsea well assembly constructed in accordance with this invention.

Referring to FIG. 3, a horizontal tree assembly 41, including a tree 43 and later a tubing hanger 44, lands on wellhead housing 15. Tree 43 is lowered with drillpipe. The tree assembly 41 includes a vertical bore 35 with lateral production outlet 36 connected to a valve 37, lateral annulus outlet 38 from below the tubing hanger and connected to a valve 40, and workover port 30 from above the tubing hanger 44, connected to the annulus outlet 38 and connected to a valve 32. After installing the tree 43 on the wellhead housing 15 and prior to installing the tubing hanger 44, a retrieval tool (not shown) is lowered through the riser into engagement with port closure sleeve 33 and retrieves port closure sleeve 33 through the bore of tree 43. A tubing hanger orientation sleeve 53 having an exterior surface lands in a shoulder 55 in tree 43. The tubing hanger orientation sleeve 53 is also in sealing engagement with the tree 43. A pin 57 located on the exterior surface of tubing hanger orientation sleeve 53 orients to a slot 56 in tree 43. The tubing hanger orientation sleeve 53 has an interior helical cam 46 and slot 48 that mates with the tubing hanger pin 50 for aligning the tubing hanger 44 with the tree 43. Tubing hanger 44, which is connected to a string of tubing 52, lands, locks, and seals in tree 43. As the tubing hanger 44 lands, it rotates to proper orientation by the interaction of the pin 50 on the cam 46 and into the slot 48.

Tree 43 has a lower interior surface that locates above the wellhead housing 15 and faces downward. A tree communication passage 47 extends upward from lower interior surface 45. Tree communication passage 47 has a lateral portion 47A that leads to an outlet (not shown) on the exterior of the tree 51.

The tubing hanger orientation sleeve 53 has a lower end that sealingly mates in the interior surface or bowl of the production casing hanger 19. Tubing hanger orientation sleeve 53 seals on the interior surface of the production casing hanger 19 at a point below communication passage 31. Communication passage 31 is exposed to an annular space surrounding orientation sleeve 53. Tubing hanger orientation sleeve 53 also seals in an interior surface 59 of tree 43 above the lower interior surface 45. A fluid communication space 61 is thus created through which production casing annulus 29 can communicate with tree communication passage 47.

In operation, the tree 43 lands, locks and seals on the wellhead housing 15. A retrieval tool lowered through the riser and blowout preventer system retrieves the port closure sleeve 33. The tubing hanger orientation sleeve 53 lands in the tree 43, is rotated until the pin 57 locates in the slot 56. In this position, the tubing hanger orientation sleeve 53 seals in the production casing hanger 19 below the communication passage 31 and in the tree 43, thereby creating a pressure-isolated, fluid communication space 61 between the production casing annulus 29 and the tree communication passage 47. The tubing hanger 44, along with a string of tubing, lands in the tree 43, orients with the tubing hanger orientation sleeve 53 as described above, and locks and seals to the tree 43. In this position, the tubing hanger 44 provides pressure-isolated communication between the production bore and the production outlet in the tree 43. Pressure in casing annulus 29 communicates through port 31, space 61 and tree communication passage 47.

Figure 4:
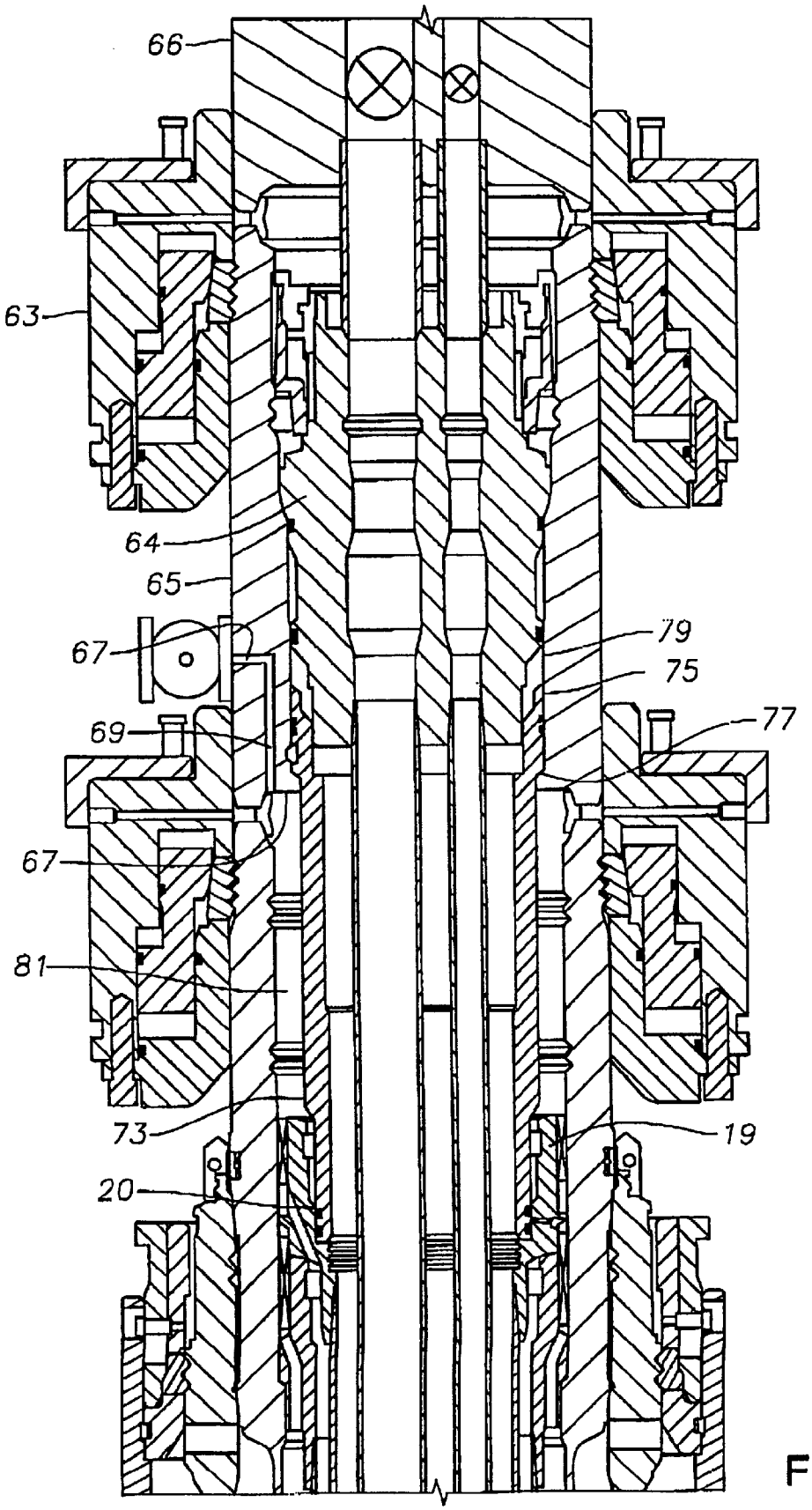
FIG. 4 is a sectional view of a second embodiment of a subsea well assembly constructed in accordance with this invention.

In the embodiment of FIG. 4, a tree assembly 63, including tubing hanger spool 65, a tubing hanger 64, and a tree 66, lands on wellhead housing 15. Tree 66, unlike the first embodiment, is not a horizontal tree. Tubing hanger 64 lands, locks, seals, and orients in tubing hanger spool 65 rather than in tree 66. Tree 66 lands on tubing hanger spool 65 after tubing hanger 64 is installed. Tubing hanger spool 65 has a lower interior surface 67 that locates above the wellhead housing 15 and faces downward. A tubing hanger spool communication passage 69 extends upward from lower interior surface 67. Tubing hanger spool communication passage 69 has a lateral portion 69A that leads to an outlet on the exterior of the tubing hanger spool 65.

A spanner sleeve 73 having an exterior surface 75 lands in a shoulder 77 in tubing hanger spool 65. Spanner sleeve 73 mates in the interior surface 20 of the production casing hanger 19. Spanner sleeve 73 seals on the interior surface 20 of the production casing hanger 19 at a point below communication passage 31. Spanner sleeve 73 also seals in an interior surface 79 of tubing hanger spool 65 above the lower interior surface 67. A fluid communication space 81 is thus created through which production casing annulus 29 can communicate with tubing hanger spool communication passage 69.

The invention has significant advantages. The communication passages enable pressure from the production casing annulus to be communicated to the exterior of the wellhead housing, without penetrating the wellhead housing and without complicating the tubing hanger with additional ports and seals. The system allows the production casing annulus pressure to be monitored when either a horizontal tree system or a tubing spool and conventional tree system are installed, without use of different production casing hanger and port closure sleeve components or tools. While the invention has been shown in only two of its forms, it should be apparent to those skilled in the art that it is not so limited but is susceptible to various changes without departing from the scope of the invention.

I claim:

1. In a subsea wellhead system having a wellhead housing secured to a first string of casing, a production casing hanger having an interior surface and an exterior surface and landed in the wellhead housing and secured to a production casing inside the first string of casing and extending below the production casing hanger, a casing hanger packoff that seals between the exterior surface of the production casing hanger and the wellhead housing, and a tree assembly that lands on the wellhead and has an axial bore, the improvement comprising:

a casing hanger communication passage passing through the production casing hanger from the exterior surface of the production casing hanger below the production casing hanger packoff to the interior surface of the production casing hanger; and a port closure sleeve having an exterior surface and an interior surface, the port closure sleeve releasably securing to the interior surface of the production casing hanger, the port closure sleeve having an exterior portion that seals against the interior wall portion of the casing hanger to close and isolate the casing hanger communication passage from communication with the interior of the port closure sleeve; the port closure sleeve being retrievable through the bore of the tree assembly after drilling has been completed.

2. A subsea wellhead system according to claim 1, further comprising:

a slot in the interior surface of the port closure sleeve which can be acted upon to remotely remove the port closure sleeve from the interior of the production casing hanger.

3. A subsea wellhead system according to claim 1, further comprising:

a first seal in the exterior surface of the port closure sleeve that sealingly contacts the interior surface of the production casing hanger above the casing hanger communication passage; and a second seal in the exterior surface of the port closure sleeve that sealingly contacts the interior surface of the production casing hanger below the casing hanger communication passage.

4. A subsea wellhead system according to claim 1, further comprising:

an isolation sleeve that has a lower end that seals to the casing hanger interior after the port closure sleeve is removed.

5. A subsea wellhead system according to claim 1, wherein:

the port closure sleeve has a maximum outer diameter less than the minimum inner diameter of the tree assembly bore.

6. In a subsea well having a wellhead housing secured to a first string of casing, a production casing hanger landed in the wellhead housing and secured to a production casing inside the first string of casing and extending below the production casing hanger, a production casing hanger pack-off that seals between the exterior of the production casing hanger and the wellhead housing, and a tree assembly which mounts on the wellhead housing and in which a tubing hanger assembly lands, the improvement comprising:

a casing hanger communication passage passing through the production casing hanger from the exterior of the production casing hanger below the production casing hanger packoff to an interior wall portion of the production casing hanger;

a port closure sleeve that releasably secures to the interior of the production casing hanger, the port closure sleeve having an exterior portion that seals against the interior wall portion of the casing hanger to close the casing hanger communication passage during drilling operations, the port closure sleeve being retrievable through the bore of the tree assembly to open the casing hanger communication passage;

a isolation sleeve having an interior surface and an upper end that lands and seals in the bore of the tree assembly, the isolation sleeve having a lower end portion that seals to the interior wall portion of the production casing hanger below the casing hanger communication passage after the port closure sleeve is removed, whereby, an annular space between the sleeve and the wellhead housing is created through which casing annulus pressure can communicate through the casing hanger communication passage; and a tree communication passage through the tree assembly that communicates with an outlet on the exterior of the tree assembly for communicating casing annulus pressure from the annular space to the exterior of the tree assembly.

7. A subsea well according to claim 6, wherein:

the tree assembly comprises a tubing spool that mounts to the wellhead housing, the tubing spool adapted to support a christmas tree.

8. A subsea well according to claim 6, wherein:

the tree assembly comprises a tree having an axial bore and a lateral production flow passage.

9. A subsea well according to claim 6, wherein:

the isolation sleeve is an orientation sleeve that orients the tubing hanger to the tree assembly.

10. A subsea well according to claim 9, wherein, the christmas tree has a recess in an interior surface of the christmas tree into which an orientation pin in the exterior surface of the isolation sleeve mates.

11. A subsea well according to claim 6, wherein, the tree assembly has an interior landing shoulder for supporting the isolation sleeve.

12. A subsea well according to claim 6, wherein:

the port closure sleeve has a threaded section located below the exterior portion for securing to a thread in the production casing hanger.

13. A subsea well according to claim 6, wherein:

the tree assembly has an axial bore with a minimum inner diameter and the exterior portion of the port closure sleeve has a smaller outer diameter than the minimum inner diameter of the bore, so as to be retrievable through the bore.

14. A subsea well according to claim 6, wherein:

the exterior portion of the port closure sleeve and the interior wall portion of the casing hanger are cylindrical.

15. In a subsea well having a wellhead housing secured to a first string of casing, a production casing hanger landed in the wellhead housing and secured to a production casing inside the first string of casing and extending below the production casing hanger, a production casing hanger pack-off that seals between the exterior of the production casing hanger and the wellhead housing, a tubing hanger spool which lands on the wellhead housing and in which a tubing hanger assembly lands, and a christmas tree which lands on the tubing hanger spool, the improvement comprising:

a casing hanger communication passage passing through the production casing hanger from an exterior of the production casing hanger below the production casing hanger packoff to an outlet in an interior of the production casing hanger;

an isolation sleeve having an interior surface and an upper end that lands and seals in the bore of the tubing hanger spool and lands in the interior of the production casing hanger and seals below the outlet of the casing hanger communication passage, whereby, a space between the tubing hanger sleeve and the wellhead housing is created through which casing annulus pressure can communicate with a tubing hanger spool communication passage; and a tubing hanger spool communication passage through the tubing hanger spool that communicates with an outlet on the exterior of the tubing hanger spool for communicating casing annulus pressure to the exterior of the tubing hanger spool.

16. A subsea well according to claim 15, wherein:

the port closure sleeve being retrievable through the bore of the tubing hanger spool and seals to the interior of the production casing hanger where the isolation sleeve seals.

17. A method for monitoring casing annulus pressure in an annulus between two strings of casing of a subsea well, the subsea well having a wellhead housing having secured to a first string of casing, the method comprising:

a) providing a casing hanger communication passage passing through a production casing hanger from an exterior surface of the production casing hanger to an interior surface of the production casing hanger; and b) installing a port closure sleeve in the production casing hanger over the casing hanger communication port to close the casing hanger communication port; and c) running a second string of casing and landing in the production casing hanger along with the port closure sleeve in the wellhead housing; and d) cementing the second string of casing while the port closure sleeve blocks the casing hanger communication port; and e) landing a tree assembly on the wellhead housing, the tree assembly having an axial bore; and f) retrieving the port closure sleeve through the bore of the tree assembly; and g) landing and orienting an isolation sleeve in the bore of the tree assembly and inserting a lower end of the isolation sleeve in the interior of the production casing hanger and sealing the lower end below the casing hanger communication passage, defining an annular chamber in the wellhead housing; and h) providing a tree communication passage through the tree assembly which communicates the annular chamber with an outlet on an exterior of the tree assembly; then i) communicating annulus pressure from between the first and second strings of casing through the casing hanger communication passage and tree communication passage to the outlet on the exterior of the tree assembly.

18. A method according to claim 17, the method additional comprising:

providing an orientation guide in the isolation sleeve; and after step (g) landing a tubing hanger in the bore of the tree assembly and orienting the tubing hanger relative to a lateral flow passage of the tree assembly with the orientation guide.

19. A method according to claim 17, wherein:

the lower end of the isolation sleeve seals in the same portion of the casing hanger as the port closure sleeve.

20. A method according to claim 17, wherein step (e) comprises landing a tubing hanger spool on the wellhead housing; and the method further comprising:

after step (e), landing a tubing hanger in the tubing hanger spool; then landing a horizontal tree having a lateral flow passage on the tubing hanger spool.

* * * * *

UNITED STATES PATENT AND TRADEMARK OFFICE

CERTIFICATE OF CORRECTION

PATENT NO. : 6,360,822 B1
DATED : March 26, 2002
INVENTOR(S) : David Neil Robertson It is certified that error appears in the above-identified patent and that said Letters Patent is hereby corrected as shown below:

Column 2,
Line 7, delete the comma (,) after "in the"

Column 8,
Line 14, change the claim number from "10" to -- 11 --
Line 18, change the claim number from "11" to -- 10 -- and reverse the sequence of these two claims.
Line 64, delete "being" and insert therefore -- is --.

Column 9,
Line 12, delete "in"
Lines 17, 19, 21 and 27, delete "and"

Signed and Sealed this

Twenty-seventh Day of August, 2002

*Attest:*

*Attesting Officer*

JAMES E. ROGAN
*Director of the United States Patent and Trademark Office*